US005092060A

United States Patent [19]

Frachey et al.

[11] Patent Number: 5,092,060

[45] Date of Patent: Mar. 3, 1992

[54] SPORTS SHOE INCORPORATING AN ELASTIC INSERT IN THE HEEL

[76] Inventors: Enrico Frachey, Via Gramsci, 8, 13058 Ponderano (Vercelli); Alfredo Crespan, Via Giovanni Comisso, 44, 31030 Mignagola Di Carbonera, both of Italy

[21] Appl. No.: 527,876

[22] Filed: May 24, 1990

[30] Foreign Application Priority Data

May 24, 1989 [IT] Italy ..... 20614 A/89

[51] Int. Cl.[5] ..... A43B 13/18; A43B 21/26

[52] U.S. Cl. ..... 36/29; 36/28; 36/114

[58] Field of Search ..... 36/35 R, 28, 29, 31, 36/37, 27, 35 B, 114

[56] References Cited

U.S. PATENT DOCUMENTS

| | | | |
|---|---|---|---|
| 74,912 | 2/1868 | Hadley . | |
| 1,559,532 | 10/1925 | Smith . | |
| 2,146,888 | 6/1938 | Fisch . | |
| 3,253,355 | 5/1966 | Menken | 36/29 |
| 4,187,620 | 2/1980 | Selner . | |
| 4,297,797 | 11/1981 | Meyers | 36/29 |
| 4,319,412 | 3/1982 | Muller et al. . | |
| 4,391,048 | 7/1983 | Lutz | 36/35 R |
| 4,472,890 | 9/1984 | Gilbert | 36/28 |
| 4,768,295 | 9/1988 | Ito | 36/28 |
| 4,783,910 | 11/1988 | Boys, II et al. | 36/35 R |
| 4,794,707 | 1/1989 | Franklin et al. | 36/31 |
| 4,845,863 | 7/1989 | Yung-Mao . | |
| 4,843,741 | 7/1989 | Yung-Mao . | |
| 4,874,640 | 10/1989 | Donzis | 36/37 |
| 4,887,367 | 12/1989 | MacKness et al. | 36/29 |
| 4,918,838 | 4/1990 | Chang | 36/29 |
| 4,970,807 | 11/1990 | Anderie et al. | 36/35 R |

FOREIGN PATENT DOCUMENTS

| | | |
|---|---|---|
| 77203615 | of 0000 | China . |
| 77206424 | of 0000 | China . |
| 601627 | 5/1948 | United Kingdom . |
| 22983 | of 0000 | Uruguay . |

OTHER PUBLICATIONS

Autry Shox Walker Publication, Oct. 17, 1988.
Adidas Catalogue, Aug. 1986.

*Primary Examiner*—Steven N. Meyers
*Attorney, Agent, or Firm*—Oblon, Spivak, McClelland, Maier & Neustadt

[57] ABSTRACT

A sports shoe having a vamp and a lower support part which includes a sole, and a wedge arranged on said sole, a mounting insole and an additional insole which is in contact with the user's foot. The shoe includes, associated with the lower support part, an insert including elements which are elastically deformable under pressure and which are enclosed in an airtight casing advantageously of a plastic material, the insert being arranged in a seat provided in the wedge and in the mounting insole in a position corresponding with the heel of the foot. A further insert may be provided at a different location of the shoe.

28 Claims, 3 Drawing Sheets

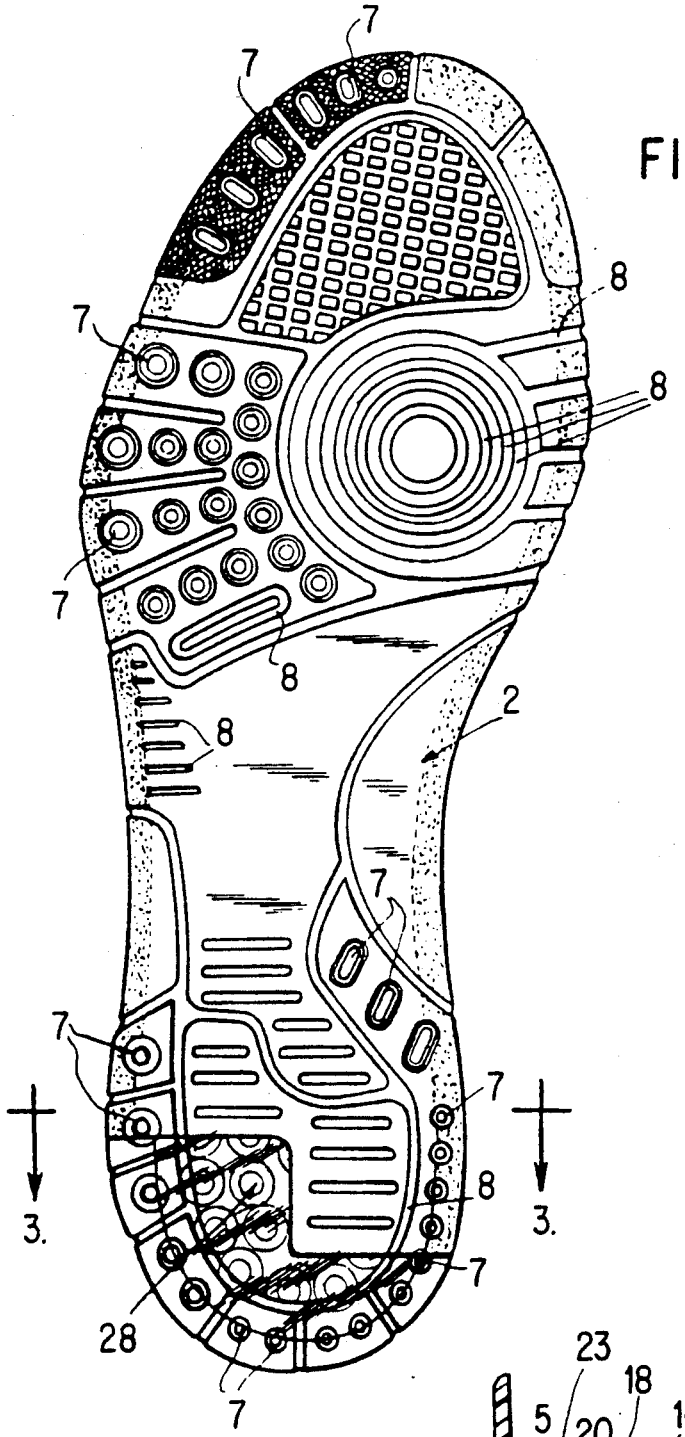
FIG. 2
FIG. 3
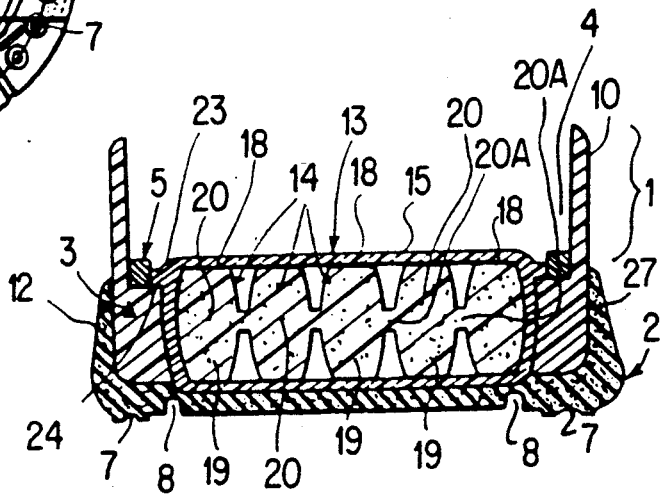

SPORTS SHOE INCORPORATING AN ELASTIC INSERT IN THE HEEL

BACKGROUND OF THE INVENTION

1. Field of the Invention

This invention relates to a sports shoe consisting of a vamp and a lower support part comprising a sole, and a wedge arranged on said sole and housing, mutually superposed, a mounting insole and a further insole which is in contact with the user's or athlete's foot during use of the shoe.

2. Discussion of the Background

For some years there has been a requirement for sports shoes during use to be able to return to the user, in the form of a thrust force, a part of the energy which has been transferred to the ground by the movement of the user, so as to facilitate lifting of the foot and thus make this movement easier to accomplish.

A particular requirement is for sports shoes of this type which:

(a) provide practically total damping of the impact derived from the leap which the user and especially the athlete executes during running, thus protecting his osseous and joint structure;

(b) optimize the position of the user's foot as he bears down on it, thus preventing the osseous structure from undergoing any type of deformation; and (c) corrects the pronation and supination defects of each user.

There are already various known constructions which attempt to satisfy the aforesaid requirements. One of these, for example, comprises an air cushion positioned in the lower support part of the shoe and of dimensions substantially equal to those of the wedge, i.e. an air cushion located along the entire lenght of the foot. Another construction comprises an insole provided over its entire lower surface with elements projecting towards the wedge, and yet another construction comprises a honeycomb structure arranged to correspond with the heel of the shoe.

All of these constructions have drawbacks which cannot be ignored. For example, the manufacture of a shoe provided with an air cushion is expensive and in any event does not completely satisfy the aforesaid requirements. In this respect, although an air cushion positioned along the entire length of the foot on the one hand results in a very comfortable shoe, it does not, on the other hand, exert the required thrust on the foot. In addition, the air cushion cannot confer good multidirectional stability and flexibility to the shoe.

Although the other shoe constructions mentioned above provide good comfort to the user's foot, they do not properly attain the stated objects. Other shoe constructions are known which on one hand at least partly satisfy the aforesaid requirements, but on the other hand are of such high cost as to put them beyond the means of that large mass of purely amateur user's who indulge in jogging.

SUMMARY OF THE INVENTION

An object of the present invention is therefore to provide a sports shoe which satisfies the aforesaid requirements and which more particularly enables a large part of the thrust transmitted by the user to the ground to be retransmitted to the user's foot. A further object is to provide a sports shoe which does not penalize the thrust action exerted by the user on the front part of the shoe, and which has multidirectional stability and flexibility.

These and further objects which will be apparent to one of ordinary skill in the art are attained by a sports shoe of the aforesaid type, characterized by including, associated with the lower support part, at least an insert comprising elements which are elastically deformable under pressure and are enclosed in an airtight casing advantageously of plastic material, said insert being arranged in a seat between a wedge and a mounting insole, in a position corresponding with the heel of the foot.

The seat is preferably provided in the wedge and is closed by the superimposed mounting insole.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 is a bottom view of the sports shoe according to the invention;

FIG. 3 is a sectional view taken along line III—III of FIG. 2; and

DESCRIPTION OF THE PREFERRED EMBODIMENT

Figure 1:
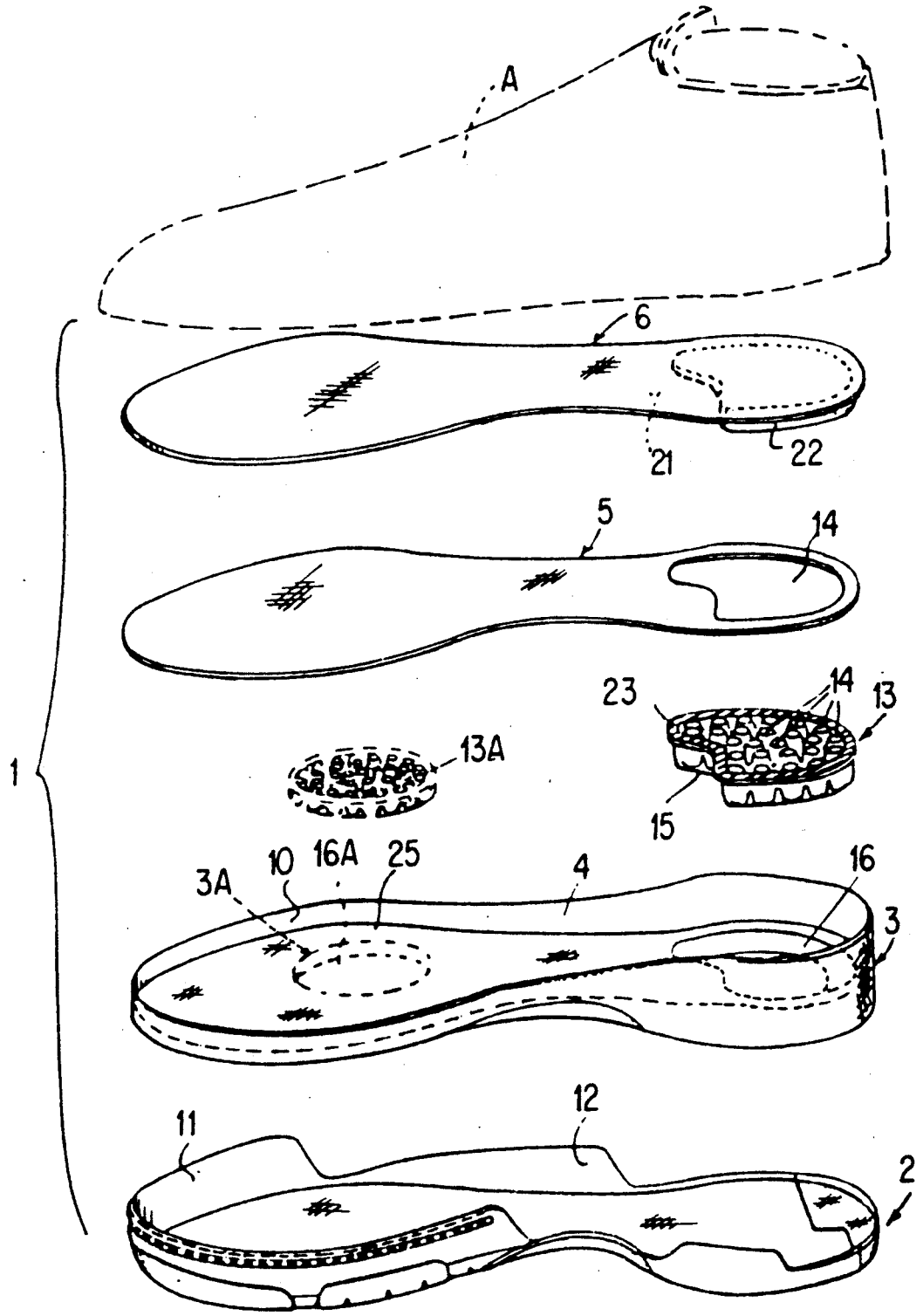
FIG. 1 is an exploded view of the lower support part of a sports shoe according to the invention.

With reference to the figures, the sports shoe of the invention comprises a vamp A and a lower support part 1 comprising a sole 2, for example of synthetic rubber, to which a wedge 3, for example of thermoplastic polyurethane, is fixed in a known manner. The wedge comprises a recess 4, bounded by a raised edge 10, carrying a mounting insole 5, for example of cork, on which there is positioned a further insole 6, for example of fabric (not shown in FIG. 3). The sole 2, constructed advantageously of rubber, comprises the usual notches 7 and incisions or recessed portions 8 in its lower surface. It also comprises a front raised edge 11, and a lateral edge 12 which extends along the entire remaining perimeter of the sole.

According to the invention, in the lower part of the shoe there is arranged an insert 13 comprising elastically deformable elements 14 made of thermoplastic material enclosed in an air-tight casing 15 constructed of plastic material such as plyurethane or a similar material. In casing 15 there is present air that has a pressure less than or equal to atmospheric pressure. In this example, the insert 13 is positioned in seats 16 and 17 provided in the wedge 3 and in the insole 5 respectively, said seats being superposed.

Alternatively, seat 17 can be omitted with insert 13 located only in seat 16 of wedge 3, so that the insole 5 is superimposed and covers seat 16.

More specifically, the elements 14 of the insert 13 are formed by molding any synthetic high-elasticity material and are substantially barrel-shaped, i.e., they are tapered at their opposing free ends 18 and 19 and have their major cross-section substantially in the central region 20 in which said elements are joined together by an integral bridging portion 20A. The barrel shaped elements are barrel shaped in the sense that all vertical cross sections taken along the vertical axis thereof are barrel shaped. Due to manufacturing requirements of insert 13, free ends 18, 19 of barrel-shaped elements 14 are fastened to casing 15. This is actually the preferred embodiment of insert 13, wherein in a first phase, elements 14 are obtained by means of molding; subsequently they are encased inside thermo-soldering plastic sheets which constitute casing 15; the elements 14 are encased by sheets when they are at a relatively high temperature so that a welding of free ends 18, 19 of elements 14 with the sheets occurs. The connection between casing 15 and the barrel-shaped elements has the advantage of anchoring said elements inside said casing, thereby preventing the casing and barrel-shaped elements from moving during use of the shoe according to the invention and so contributing together with the mutual connection of the barrel-shaped elements 14 to the good multidirectional stability and flexibility of the resulting shoe. This affords a greater stability for insert 13 within the shoe, and permits better performance of the function for which it is intended, which functions will be further defined below.

The shape of the elements 14, as shown and described by way of example, allows considerable absorption of the stresses caused by the user's foot as he moves, and at the same time allows a large part of the absorbed energy to be retransmitted rapidly but gradually to the foot.

In order to secure the insert 13 within the seats 16 and 17, the insole 6 comprises on that face 21, facing the insole 5, a projection 22 of a shape corresponding to said seats and arranged to cooperate with them and with the insert 13. In the alternative embodiment recited above, the projection 22 can be omitted.

The casing 15 of insert 13 comprises a flange 23 which, when the insert 13 has been positioned in the lower part 1 of the shoe, rests on a step 24 provided between the insole 5 and an inner surface 25 of the wedge 3. In the alternative, where the hole or seat 17 is omitted, the flange 23 (very thin) rests on the contour of the wedge seat 16.

Finally, the sole comprises a reinforcement element 28 positioned below the insert 13 or in other positions of the sole where others inserts may be located, said reinforcement element 28 being formed, for example, of plastic material e.g. of natural or synthetic rubber and being advantageously somewhat transparent. Element 28 may or may not be tinted. Reinforcing element 28 is of a wear and abrasion resistant material and is preferably located in the heel portion and in the metatarsal portion of the sole.

During the use of a shoe according to the invention, each time the user presses the lower part 1 of the shoe with his foot, the insert 13 is pressed towards the sole 2. Specifically, the pressing action exerted by the foot depresses the elements 14 which deform and increases the pressure within the airtight casing 15 which is constricted by the surrounding wall portion of its seat. When the user's heel ceases its pressing action, the elements 14 return to their initial configuration, so as to transmit a large part of the energy acquired during the pressing action to the user's foot, which therefore receives a gradual thrust as his heel (or other part of the foot, e.g. the metatarsal one) separates from the ground. To said thrust, exerted on the user's foot by elements 14, there must be added the thrust exerted by the air which is present inside insert 13, this air being under pressure due to the action by the user's foot. These combined thrusts help transfer to the user's foot part of the energy transmitted by the user to the ground during movement.

Elastic inserts like the one disclosed above can be located in the other regions of the support part 1, in particular in proximity to the frontal region of the sole 2 and wedge 3 and more particularly in the metatarsal zone 3A as shown in dotted lines in FIG. 1, where the seat is referenced by 16A and the insert by 13A, thus allowing the user (particularly an athlete) to obtain increased pickup during acceleration or during changes in the rate of movement.

Figure 4:
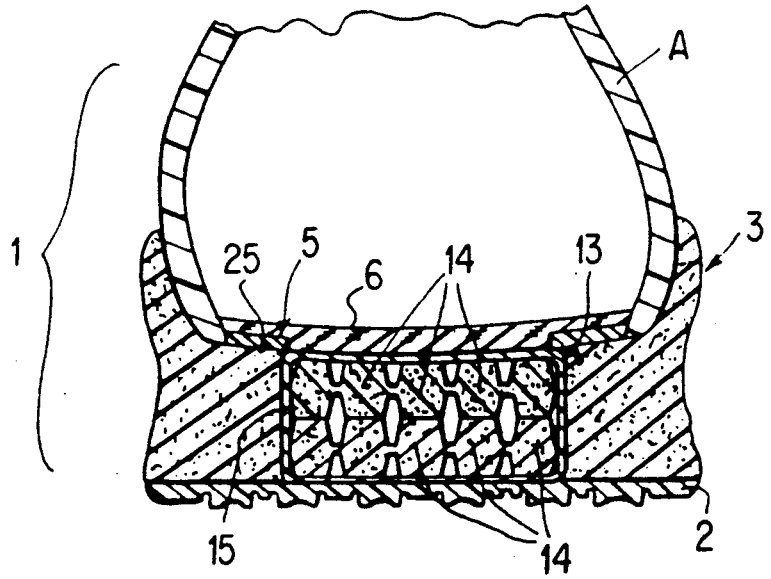
FIG. 4 is a sectional view of an alternate embodiment.
Figure 1:
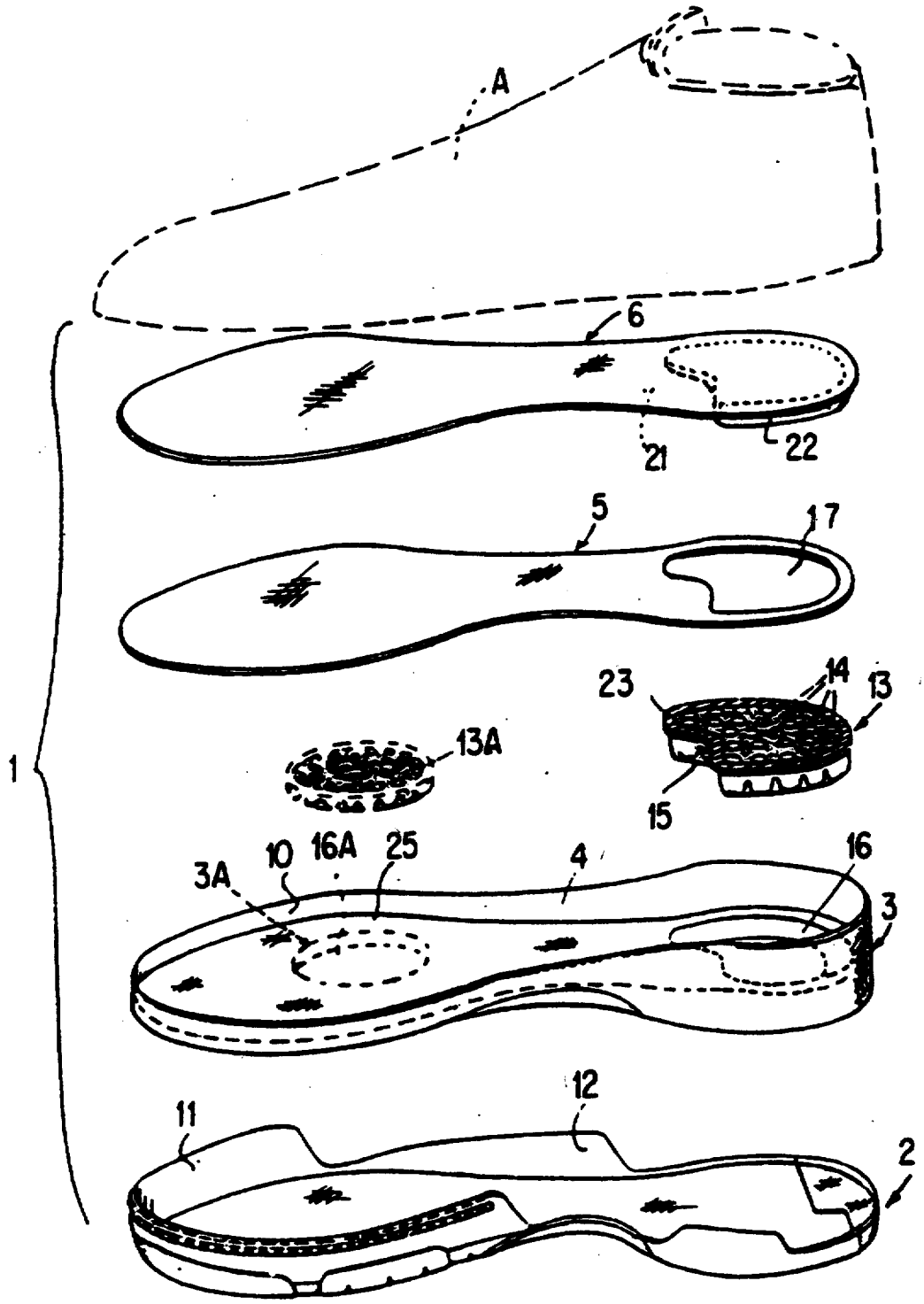

The insert 13 shown in FIG. 1 and 3 comprises only one layer of elements 14; however, there can be provided an insert 13 having two or more layers of elements 14 superimposed as shown in FIG. 4. In particular, if the above cited insert has two layers of elements 14, a first layer supports the second whose deformable elements rest on the elements positioned below.

This further permits an improvement in the return of part of the energy (passed on by the user to the ground) to the foot of the user. It must be noted that, in the same manner previously described, free ends 18, 19 of barrel-shaped element 14, are fastened to (or soldered on) casing 15, whereas the contact surfaces of the two layers of element 14, if used, would be fastened to (or soldered on) each other. This affords stability for insert 13, preventing one of the layers from sliding over the other one within casing 15. A shoe constructed in accordance with the invention satisfies the aforesaid requirements and in particular enables most of the energy expended during movement to be retransferred to the foot.

Obviously, numerous modifications and variations of the present invention are possible in light of the above teachings.

One of these different embodiments of the present invention is shown by dotted line in FIG. 1; this embodiment comprises an additional insert 13A located in seat 16A provided in metatarsal area 3A of wedge 3.

Also, insert 13A can comprise one or more layers of interconnected barrel-shaped elements 14.

It is therefore to be understood that within the scope of the appended claims, the invention may be practiced otherwise than as specifically described herein; in particular, other than insert 13 positioned in the heel area of wedge 3, the invention can comprise another insert positioned in properly selected areas of said wedge (such as the arch area), said insert(s) being similar to insert 13.

What is claimed as new and desired to be secured by letters patent of the United States is:

1. A sports shoe which comprises:

a vamp; and a lower support part connected to said vamp and which comprises a sole, a wedge arranged on said sole and housing, mutually superposed, a mounting insole, an insole for contacting a user's foot, and a seat provided in said wedge;

at least an insert mounted in said lower support part and which includes an airtight casing and a plurality of elements which are elastically deformable under pressure and which are enclosed in said airtight casing, said insert being positioned in said seat in a position corresponding with a heel of the foot of a user wherein said elastically deformable elements are barrel shaped such that all vertical cross sections taken along a vertical axis thereof are barrel shaped.

2. A shoe as claimed in claim 1, wherein said elastically deformable elements are tapered towards opposing free ends thereof and have a major cross-section in a central region thereof.

3. A shoe as claimed in claim 1 or 2, wherein said insert has at least one layer of elastically deformable elements joined together in a central region thereof.

4. A shoe as claimed in claim 3, wherein a first and second layer of elastically deformable elements are superimposed inside said insert such that elements of said first layer rest on elements of said second layer.

5. A shoe as claimed in claim 4, wherein said elements of said first and second layer each have free ends connected to said casing and adjacent free ends of said elements are interconnected.

6. A shoe as claimed in claim 3, which comprises a casing, and means for fastening free ends of said elements to said casing.

7. A shoe as claimed in claim 1, wherein the sole comprises a reinforcement element of at least partially transparent plastic material.

8. A shoe as claimed in claim 1 comprising at least one additional insert located in a different seat of the wedge, said insert including an airtight casing and a plurality of elements which are elastically deformable under pressure and which are enclosed in said airtight casing, said elastically deformable elements tapering towards opposing free ends thereof and having a major cross-section in a central region thereof.

9. A shoe as claimed in claim 8 wherein the additional insert has at least one layer of elastically deformable elements joined together in their central region.

10. A shoes as claimed in claim 8, wherein the at least one additional insert comprises an additional casing and means for fastening free ends of elastically deformable elements to said additional casing.

11. A shoe as claimed in claim 8 wherein the additional insert is positioned in the metatarsal foot area of the wedge.

12. A shoe as claimed in claim 8 wherein the additional insert is positioned in the arch foot area of the wedge.

13. A shoes as claimed in claim 8, wherein a first and second layer of elastically deformable elements are superimposed inside said insert such that elements of said first layer rest on elements of said second layer, said elements of said first and second layer each having free ends connected to said casing and wherein adjacent free ends of said elements are interconnected.

14. A shoes as claimed in claim 8, wherein the sole comprises a reinforcement element of an at least partially transparent plastic material located at each additional insert of the shoe.

15. A sports shoe which comprises:

a vamp; and a lower support part connected to said vamp and which comprises a sole, a wedge arranged on said sole and housing, mutually superposed, a mounting insole, an insole for mutually superposed, a mounting insole, an insole for contacting a user's foot, and a seat provided in said wedge;

at least an insert mounted in said lower support part and which includes an airtight casing and a plurality of elements which are elastically deformable under pressure and which are enclosed in said airtight casing, said insert being positioned in said seat in a position corresponding with a heel of the foot of a user wherein said insole for contacting the user's foot comprises a face portion facing said mounting insole and a projection of a shape corresponding to the shape of said seat means in which the insert is positioned.

16. A sports shoe which comprises:

a vamp; and a lower support part connected to said vamp and which comprises a sole, a wedge arranged on said sole and housing, mutually superposed, a mounting insole, an insole for contacting a user's foot, and a first and second seat provided in said wedge;

a first insert mounted in said lower support part and which includes an airtight casing and a plurality of barrel shaped elements which are of a barrel shape in all vertical cross sections taken along a vertical axis thereof and are elastically deformable under pressure and which are enclosed in said airtight casing, said insert being positioned in said first seat in a position corresponding with a heel of the foot of a user;

a second insert mounted in said lower support part and which includes an airtight casing and a plurality of barrel shaped elements such that all vertical cross sections taken along a vertical axis thereof are barrel shaped, said elements being elastically deformable under pressure and being enclosed in said airtight casing, and said insert being positioned in said second seat in a different position from that of said first seat for said first insert.

17. A shoe as claimed in claims 16, wherein each insert has at least one layer of said elastically deformable elements joined together in a central region thereof, said elastically deformable elements being tapered towards opposing free ends thereof and having a major cross-section in their central region.

18. A shoe as claimed in claim 17, wherein each insert comprises a casing, means for fastening free ends of said elements to said casing.

19. A shoe as claimed in claim 16, wherein a first and second layer of elastically deformable elements are superimposed inside each insert such that elements of said first layer rest on elements of said second layer, said elements of said first and second layer each having free ends connected to said casing and adjacent free ends of said elements are interconnected.

20. A shoe as claimed in claim 16, wherein the sole comprises reinforcement elements of at least partially transparent plastic material, said elements being located at each insert.

21. A sports shoe which comprises:

a vamp; and a lower support part connected to said vamp and which comprises a sole, a wedge arranged on said sole and housing, mutually superposed, a mounting insole, for contacting a user's foot, and a plurality of seats provided in said wedge;

a plurality of inserts mounted in said lower support part and which includes an airtight casing and a plurality of barrel shaped elements such that all vertical cross sections taken along a vertical axis thereof are barrel shaped, said elements being elastically deformable under pressure and being enclosed in said airtight casing, and each of said inserts being respectively positioned in said seats of the wedge.

22. A shoe as claimed in claim 21, wherein one of said plurality of inserts is located in the heel area of the wedge.

23. A shoe as claimed in claim 21, wherein one of said plurality of inserts is located in a metatarsal foot area of the wedge.

24. A shoe as claimed in claim 21, wherein one of said plurality of inserts is located in the arch foot area of the wedge.

25. A shoe as claimed in claims 21, wherein each insert has at least one layer of said elements joined together in a central region thereof, said elements being tapered towards opposing free ends thereof and having a major cross-section in their central region.

26. A shoe as claimed in claim 25, wherein each insert comprises means for fastening free ends of said elements to said casing.

27. A shoe as claimed in claim 21, wherein a first and second layer of said elements are superimposed inside each insert such that elements of said first layer rest on elements of said second layer, said elements of said first and second layer each having free ends connected to said casing and wherein adjacent free ends of said elements are interconnected.

28. A shoe as claimed in claim 21, wherein the sole comprises reinforcement elements of at least partially transparent plastic material, each reinforcement element being located at each insert.

* * * * *

UNITED STATES PATENT AND TRADEMARK OFFICE

CERTIFICATE OF CORRECTION

PATENT NO. : 5,092,060

DATED : March 3, 1992

INVENTOR(S) : Enrico Frachey, Alfredo Crespan

It is certified that error appears in the above-identified patent and that said Letters Patent is hereby corrected as shown below:

Title page, before "[21] Appl. No.:", insert --Assignee: Global Sports Technologies, Inc.--.
Column 1, line 36, change "lenght" to --length--.
Column 1, line 58, Change "user's" to --users--.
Column 2, line 52, change "plyurethane" to --polyurethane--.
Column 5, line 33, change "shoes" to --shoe--.
Column 5, line 43, change "shoes" to --shoe--.
Column 5, line 50, change "shoes" to --shoe--.
Column 5, line 55, delete "and".
Column 5, lines 59 and 60, delete "mutually superposed, a mounting insole, an insole for".
Column 5, line 61, insert --and-- after "wedge;".
Column 6, line 30, change "claims" to --claim--.
Column 6, line 37, after "casing" insert --and--.
Column 6, line 37, after "casing" delete ",".
Column 7, line 7 (as renumbered), change "claims" to --claim--.

Signed and Sealed this

Twenty-first Day of September, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,092,060

DATED : MARCH 3, 1992

INVENTOR(S) : Enrico FRACHEY et al

It is certified that error appears in the above-indentified patent and that said Letters Patent is hereby corrected as shown below:

The drawing sheet, consisting of Fig. 1, should be deleted to replaced with the drawing sheet, consisting of Fig. 1, as shown on the attached page.

Signed and Sealed this

Eighteenth Day of June, 1996

*Attest:*

Bruce Lehman

BRUCE LEHMAN

*Attesting Officer*

*Commissioner of Patents and Trademarks*